US009022342B2

(12) United States Patent
Witte et al.

(10) Patent No.: US 9,022,342 B2
(45) Date of Patent: May 5, 2015

(54) JACK PLATE FOR PONTOON BOAT

(75) Inventors: Alan D. Witte, St. Coud, MN (US); Ralph Lermayer, Bent, NM (US)

(73) Assignee: Lermayer Outdoors, Inc., Tularosa, NM (US)

( * ) Notice: Subject to any disclaimer, the term of this patent is extended or adjusted under 35 U.S.C. 154(b) by 0 days.

(21) Appl. No.: 13/406,961

(22) Filed: Feb. 28, 2012

(65) Prior Publication Data

US 2012/0298833 A1 Nov. 29, 2012

Related U.S. Application Data

(60) Provisional application No. 61/447,641, filed on Feb. 28, 2011.

(51) Int. Cl.

| | |
|---|---|
| ***F16M 5/00*** | (2006.01) |
| ***B63H 5/125*** | (2006.01) |
| ***B63B 1/00*** | (2006.01) |
| ***B63H 20/06*** | (2006.01) |
| *B63B 35/34* | (2006.01) |
| *B63H 20/00* | (2006.01) |

(52) U.S. Cl.

CPC ..... *B63H 20/06* (2013.01); *B63B 35/34* (2013.01); *B63H 2020/003* (2013.01)

(58) Field of Classification Search

CPC ..... B63B 35/34; B63H 20/06; B63H 5/20; B63H 20/08; B63H 20/007; B63H 2020/003

USPC ..... 114/61.1, 299; 440/53; 248/640–643

See application file for complete search history.

(56) References Cited

U.S. PATENT DOCUMENTS

| | | | | | |
|---|---|---|---|---|---|
| 2,643,837 | A | * | 6/1953 | Rivers | 248/641 |
| 2,713,843 | A | * | 7/1955 | Staley | 440/63 |
| 2,886,462 | A | * | 5/1959 | Jagiel | 248/617 |
| 3,123,840 | A | * | 3/1964 | Cefalo, Jr. | 114/354 |
| 3,645,483 | A | * | 2/1972 | Bartosch et al. | 248/641 |
| 3,918,666 | A | * | 11/1975 | Florian | 248/641 |
| 3,968,768 | A | * | 7/1976 | Solt | 440/62 |
| 4,482,330 | A | * | 11/1984 | Cook | 440/2 |
| 4,878,864 | A | * | 11/1989 | Van Bentem | 440/5 |
| 5,029,800 | A | * | 7/1991 | Ponican | 248/241 |
| 5,030,146 | A | * | 7/1991 | Chung | 440/54 |
| 5,137,249 | A | * | 8/1992 | Royster | 248/642 |
| 5,485,981 | A | * | 1/1996 | Lindahl | 248/641 |
| 5,697,820 | A | * | 12/1997 | Saito et al. | 440/57 |

(Continued)

FOREIGN PATENT DOCUMENTS

| | | | |
|---|---|---|---|
| DE | 1194726 | * | 5/1965 |
| DE | 3153699 | * | 4/1992 |

(Continued)

*Primary Examiner* — Joshua J Michener
*Assistant Examiner* — Chiedu Chibogu
(74) *Attorney, Agent, or Firm* — Christensen Fonder P.A.

(57) ABSTRACT

A jack plate for easily and effectively mounting a secondary motor to a pontoon boat. The mount comprises a horizontal supporting member affixable to a pontoon decking and a downward member rigidly and operably coupled to the horizontal supporting member and extending from the horizontal member downwardly, wherein the motor is operably coupled to the downward member. Optionally, the mount further comprises a supporting member operably coupled on a first end at an intermediate position to the downward member, wherein a second end of the supporting member is affixable to a pontoon hull extension.

14 Claims, 7 Drawing Sheets

(56) References Cited

U.S. PATENT DOCUMENTS

| | | | | |
|---|---|---|---|---|
| 6,352,456 | B1 * | 3/2002 | Jaszewski et al. | 440/53 |
| 6,477,969 | B2 * | 11/2002 | Schell-Tomczak et al. | 114/61.1 |
| 6,715,440 | B2 * | 4/2004 | Biedenweg et al. | 114/363 |
| 7,263,940 | B2 * | 9/2007 | Yetter et al. | 114/61.1 |
| 7,354,323 | B1 * | 4/2008 | Mayers | 440/53 |
| 7,828,614 | B2 * | 11/2010 | Cribbs | 440/53 |
| 8,132,523 | B2 * | 3/2012 | White, Jr. | 114/61.1 |
| 2004/0262488 | A1 * | 12/2004 | Kozubski | 248/642 |
| 2005/0255761 | A1 * | 11/2005 | Bernloehr et al. | 440/6 |
| 2005/0279912 | A1 * | 12/2005 | Kozubski | 248/642 |
| 2009/0130926 | A1 * | 5/2009 | Jaszewski et al. | 440/52 |
| 2010/0127150 | A1 * | 5/2010 | Wakeham | 248/642 |
| 2011/0011812 | A1 * | 1/2011 | Johnson et al. | 211/1 |

FOREIGN PATENT DOCUMENTS

| | | | |
|---|---|---|---|
| FR | 2781755 | A1 * | 2/2000 |
| WO | WO 9006883 | * | 6/1990 |

* cited by examiner

JACK PLATE FOR PONTOON BOAT

PRIORITY CLAIM

This application is a non-provisional and claims priority to U.S. Provisional Application No. 61/447,641, filed Feb. 28, 2011 and entitled "JACK PLATE FOR PONTOON BOAT", which application is herein incorporated by reference in its entirety.

TECHNICAL FIELD OF THE INVENTION

The present invention relates to accessories for boats and outboard motors. More particularly, it relates to jack plates for pontoon boats.

BACKGROUND OF THE INVENTION

Trolling motors are traditionally used to slowly and quietly hold the position of a boat or to gently propel a boat through water. However, on flat-bottomed pontoon boats, the pontoon hull structures that support the weight of the boat often extend beyond the plane of the stern, as well as the bow, and therefore obstruct the locations where a trolling motor would traditionally be placed. Further, the shape of the transom of most pontoon boats is not adapted to easily attach a secondary motor. Additionally, it is unwise to mount anything to the pontoon hull structures themselves because of the potential for destroying the integrity of the hull and, in turn, destroying the floatability properties of the hull. Thus, it is problematic to use trolling motors on pontoon boats.

SUMMARY OF THE INVENTION

The device of the present application substantially meets the aforementioned needs of the industry. The jack plate provides a mechanism for easily and effectively mounting a secondary motor to a pontoon boat.

In one embodiment of the present invention, a jack plate includes a horizontal member or parallel horizontal members secured to the deck of a boat working in combination with an attached downward member. In the case where the pontoon hull structures that support the weight of the boat extend beyond the plane of the stern and obstruct the locations where a trolling motor would traditionally be placed, an outboard motor can be coupled to the downward member directly or via a secondary adapter bracket coupled to the downward member such that the motor extends downward beyond the bulk of the pontoon hull and the motor propeller extends into the water.

Further, because of the support provided by the horizontal member or parallel horizontal members and an optional bracing member functioning with the downward member, a secondary motor is able to be attached to the boat. The void between the starboard side pontoon hull and the port side pontoon hull is traditionally where the primary motor is located. Further, most pontoon boats generally lack a transom. Thus, any secondary motor must be adapted to attach somewhere other than in the hull void in a manner besides being affixed to a transom (and, of course, without being affixed to the pontoon hull). The device of the present invention provides exactly that flexibility by providing the downward member, which becomes a motor-attachable stable structure.

Additionally, the horizontal member or parallel horizontal members of the jack plate that are secured to the deck of the boat have a substantially flat profile. As such, they can easily be placed under any carpeting, flooring, or other deck covering material. Likewise, should the horizontal member or parallel horizontal members be secured to the deck by placement on top of the deck covering material, the flat profile provides minimal intrusion on the surface of the deck, thus maximizing the usability of the deck.

Further, the optional bracing member provides additional stability to the downward member as the downward member and attached motor flex in the water. The pivoting joint that interfaces with the downward member allows the downward member to remain stable and rigid, thus reducing strain on the joint at which the horizontal member and the downward member meet as well as at the section of horizontal member that extends horizontally beyond the deck of the boat.

Also, because the bracing angle is adjustable, the bracing member can be mounted to the structure that extends from the pontoon hull at any number of different angles. The bracing angle doesn't need to be perfectly parallel to the pontoon hull or at a perfect right angle to the downward member. Accordingly, the device of the present application can be mounted on any number of pontoon boat styles.

The device of the present application is designed with such minimal contacts to the frame of the boat that it is easily integrated into boats being newly constructed as part of a secondary motor enhancement, as well as retrofitted into existing boats. Therefore, the device of the present application has wide application.

Further, the motor attached to the downward member does not need to be below the pontoon hull in order to operate. As such, the pontoon hulls provide protection to the motor propeller and the rest of the motor. For example, a motor in a traditional position extends beyond the pontoon hull. Because of this extension, the propeller and other parts of the motor are placed at risk of contacting objects in the water below the hull, which could potentially damage the motor or the objects. However, in the present invention, because the motor is not extended below the hull, the pontoon hull acts as a barrier to the motor, thus preventing it from contacting objects in the water.

BRIEF DESCRIPTION OF THE DRAWINGS

The invention may be more completely understood in consideration of the following detailed description of various embodiments of the invention, in connection with the accompanying drawings, in which.

Figure 1:
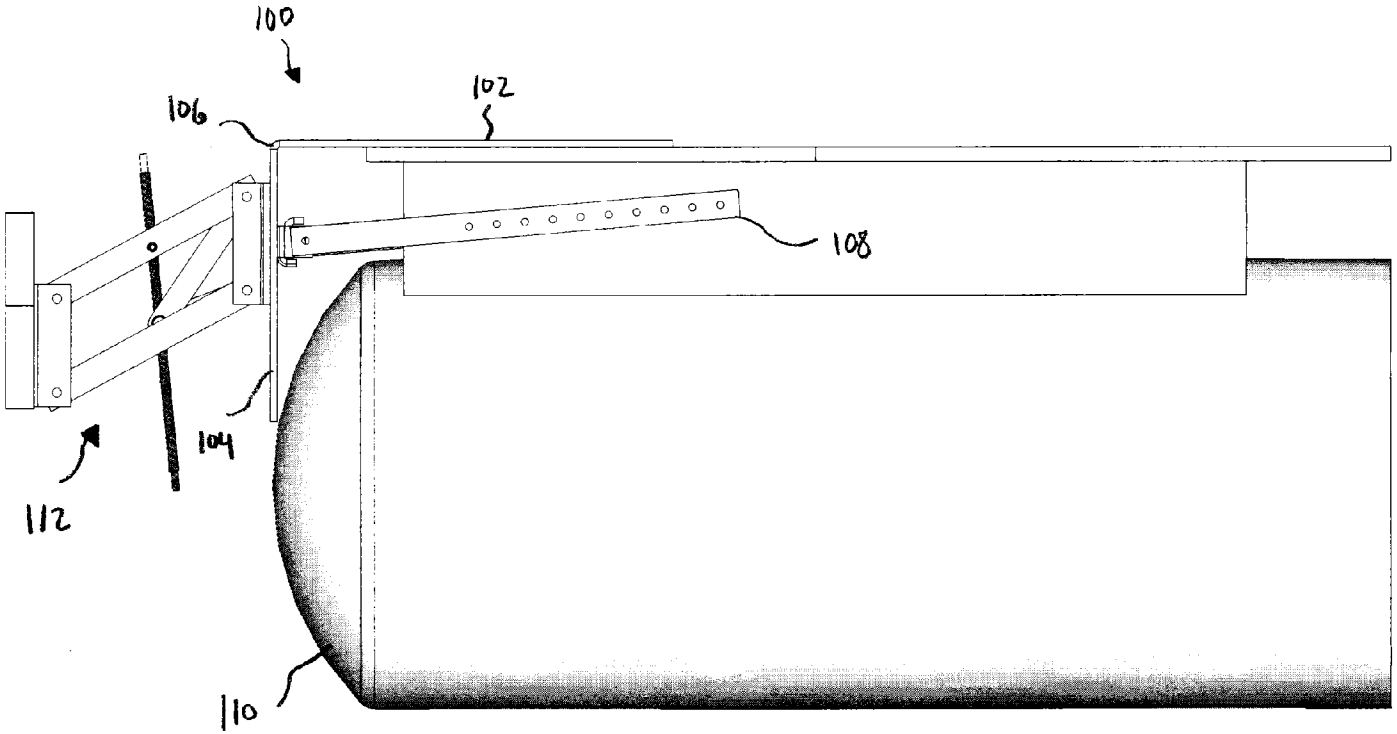
FIG. 1 is a side elevational view of a jack plate mounted over a pontoon hull.
Figure 2:
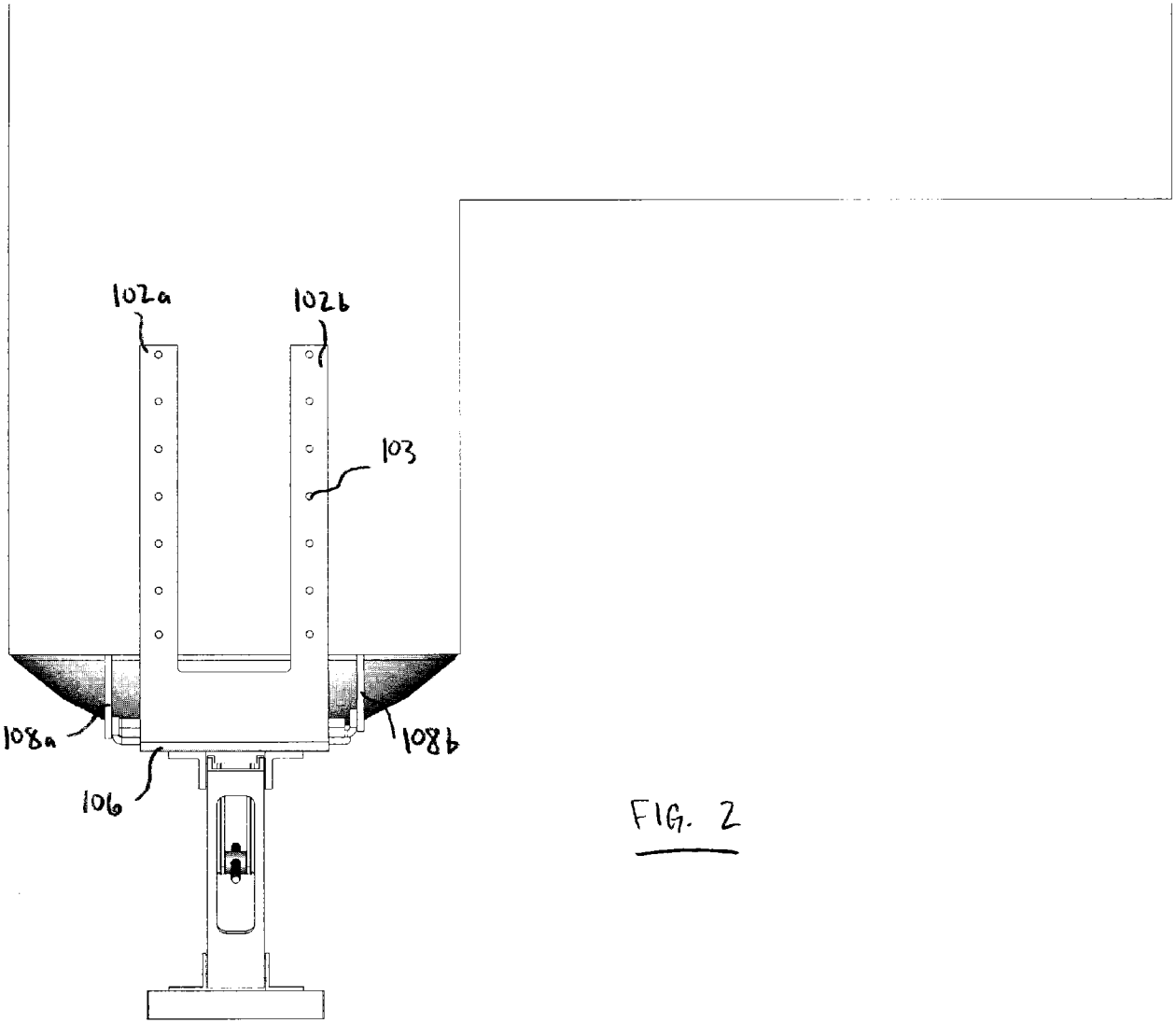
FIG. 2 is a top platform view of a jack plate mounted over a pontoon hull.
Figure 3:
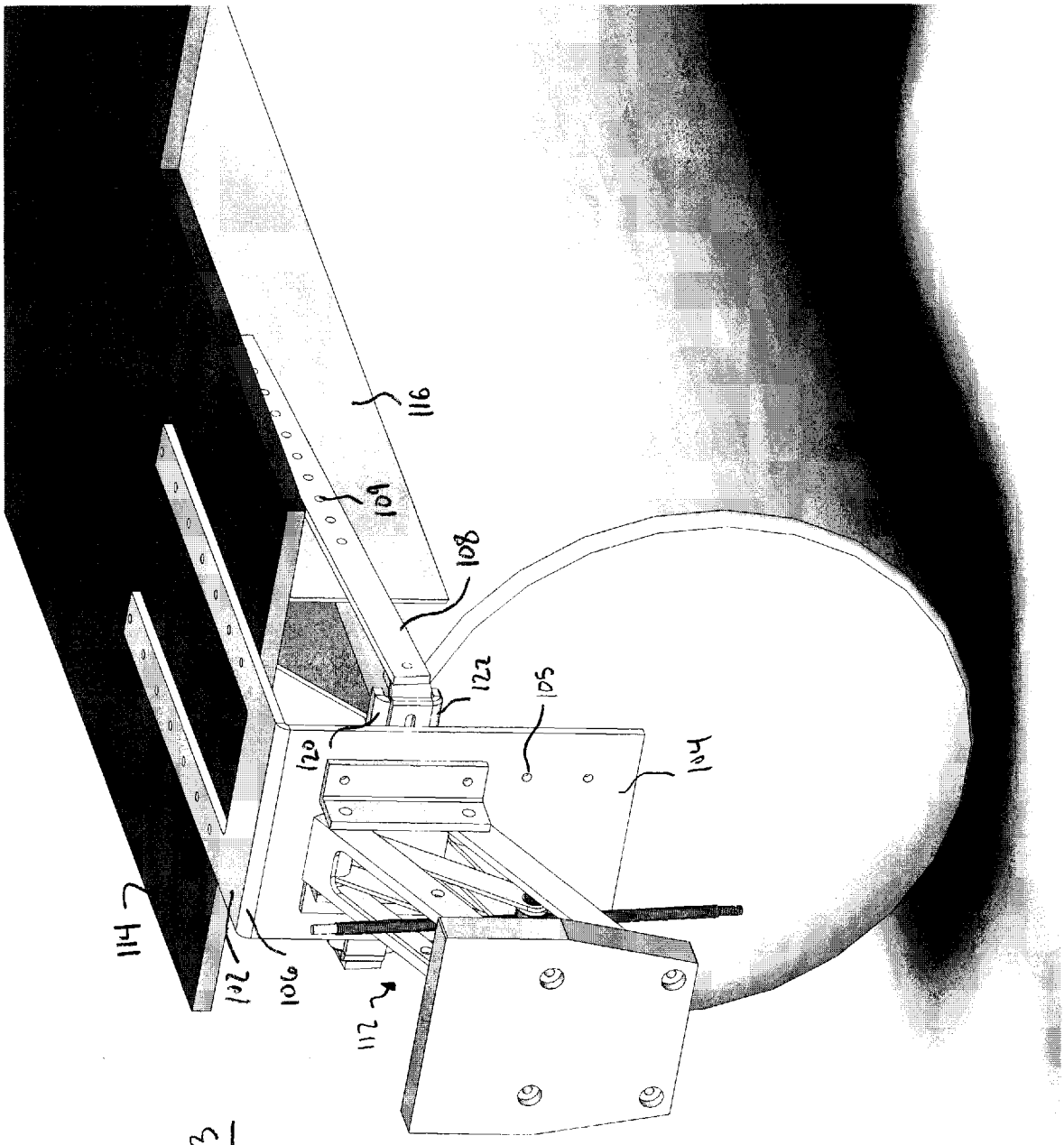
FIGS. 3-5 are perspective views of a jack plate mounted over a pontoon hull.
Figure 4:
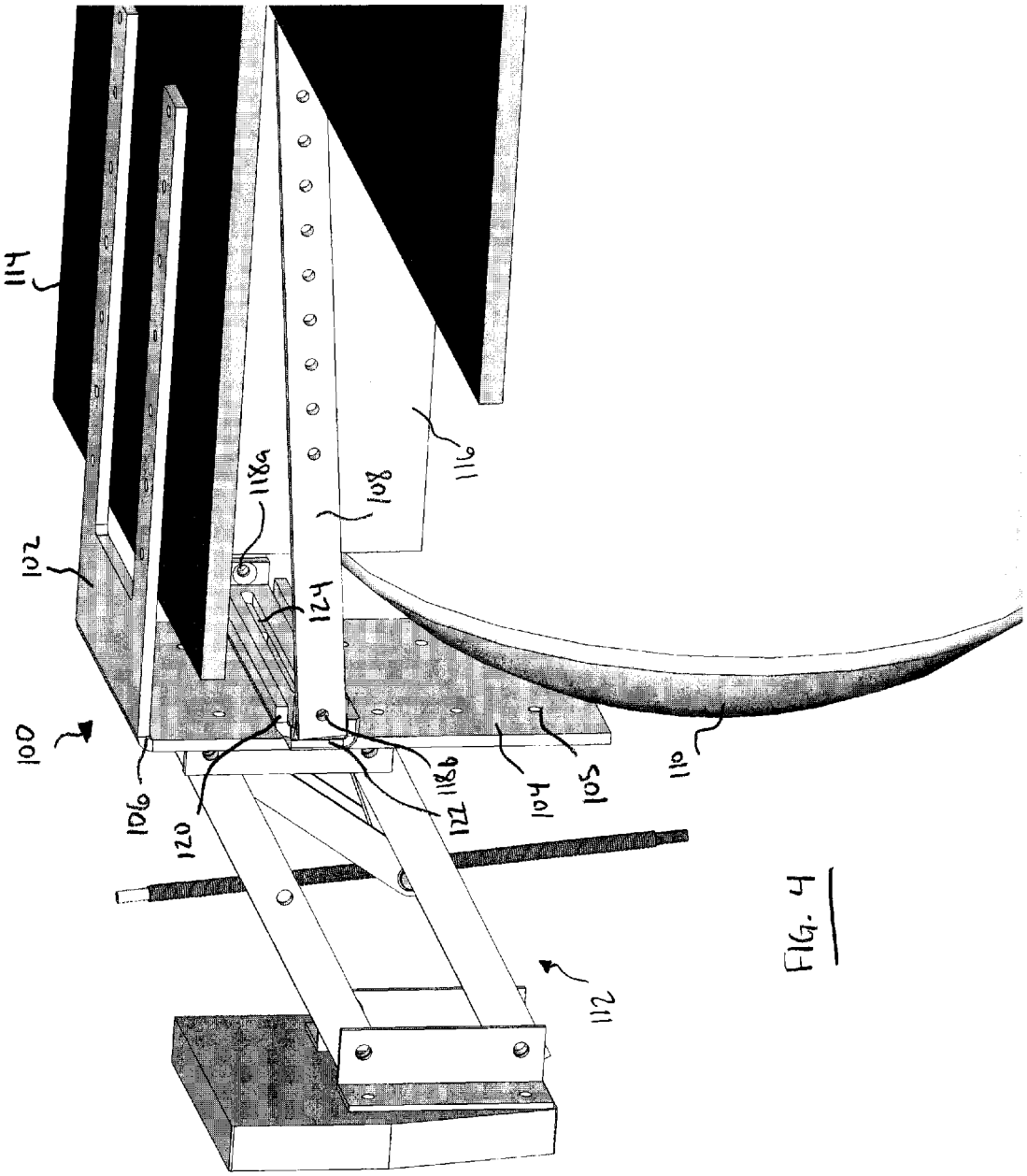
Figure 5:
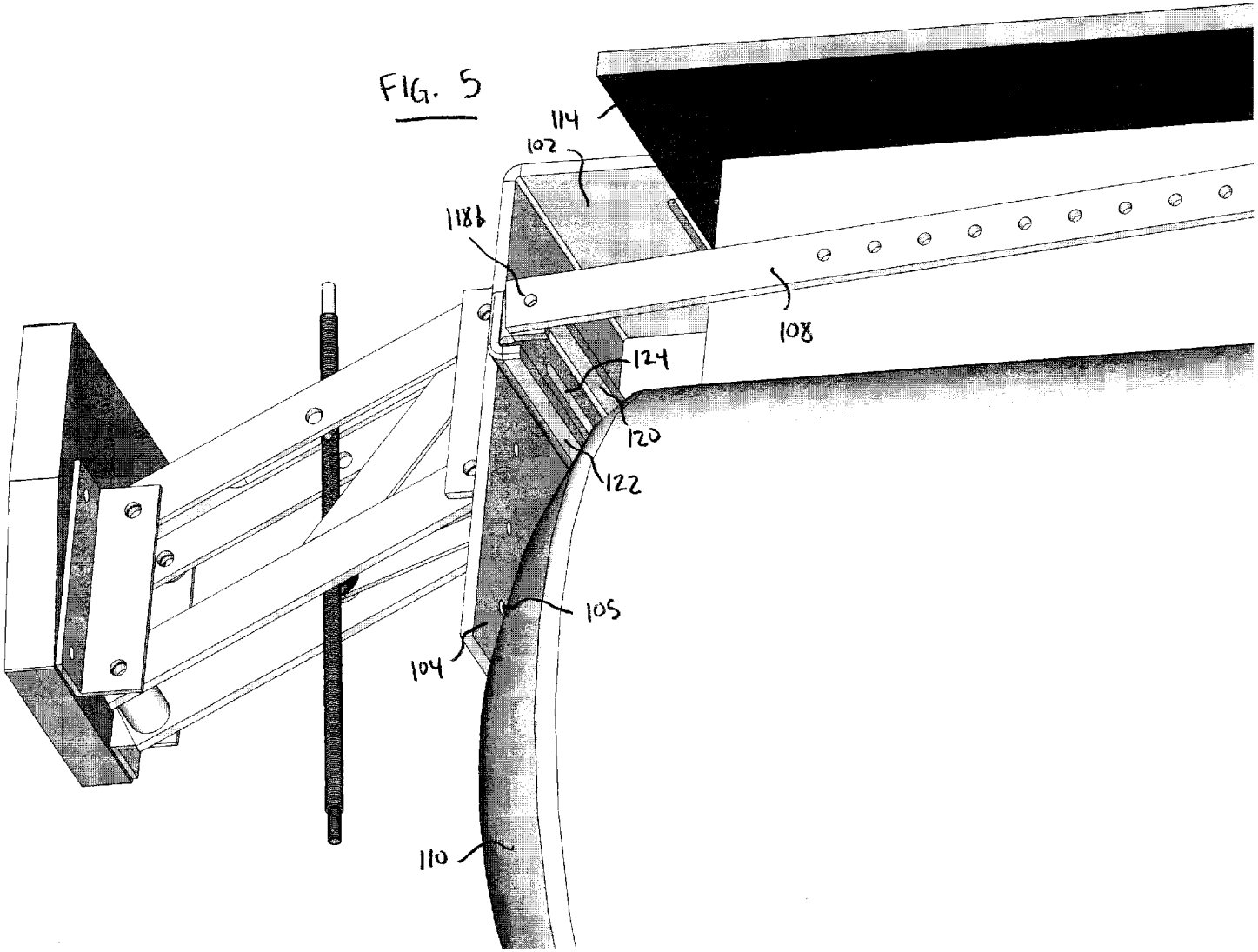

While the invention is amenable to various modifications and alternative forms, specifics thereof have by shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims and their equivalents.

DETAILED DESCRIPTION OF THE DRAWINGS

Referring generally to FIGS. 1-6, a jack plate 100 for a pontoon boat is illustrated. The jack plate 100 generally comprises horizontal member 102, downward member 104 extending downward from horizontal member 102, and supporting member 108. Jack plate 100 provides a rigid structure for mounting a secondary motor 126 over a pontoon hull 110.

Horizontal member 102 comprises first horizontal extension 102*a* and second horizontal extension 102*b*. Horizontal extensions 102*a* and 102*b* are secured into decking platform 114 with any appropriate fasteners via apertures 103 such that horizontal member 102 is mechanically joined to decking platform 114. Apertures 103 run along the length of both first horizontal extension 102*a* and second horizontal extension 102*b*. Horizontal extensions 102*a* and 102*b* provide the bulk of the support for jack plate 100.

Downward member 104 is rigidly attached to horizontal member 102 at joint 106. Apertures 105, which run in parallel rows along the length of downward member 104, provide a mechanism for utilizing fasteners to mechanically join a motor 126 or a secondary adapter bracket 112 to downward member 104, as well as to mechanically join supporting member 108 to downward member 104. In FIGS. 1-6, an adapter bracket 112 is illustrated as being intermediary between downward member 104 and a motor 126. However, a motor 126 may be directly coupled to downward member 104 utilizing the same apertures 105 as are utilized in attaching adapter bracket 112.

Referring specifically to FIGS. 3-6, supporting member 108 comprises first supporting extension 108*a* and second supporting extension 108*b*. First supporting extension 108*a* contains aperture 118*a* for fastening first supporting extension 108*a* to downward member 104. Similarly, second supporting extension 108*b* contains aperture 118*b* for fastening second supporting extension 108*b* to downward member 104. Supporting extensions 108*a* and 108*b* are coupled to pontoon hull extension 116 with fasteners that can be affixed through apertures 109, which run for the majority of the length of extensions 108*a* and 108*b*, respectively.

Figure 6:
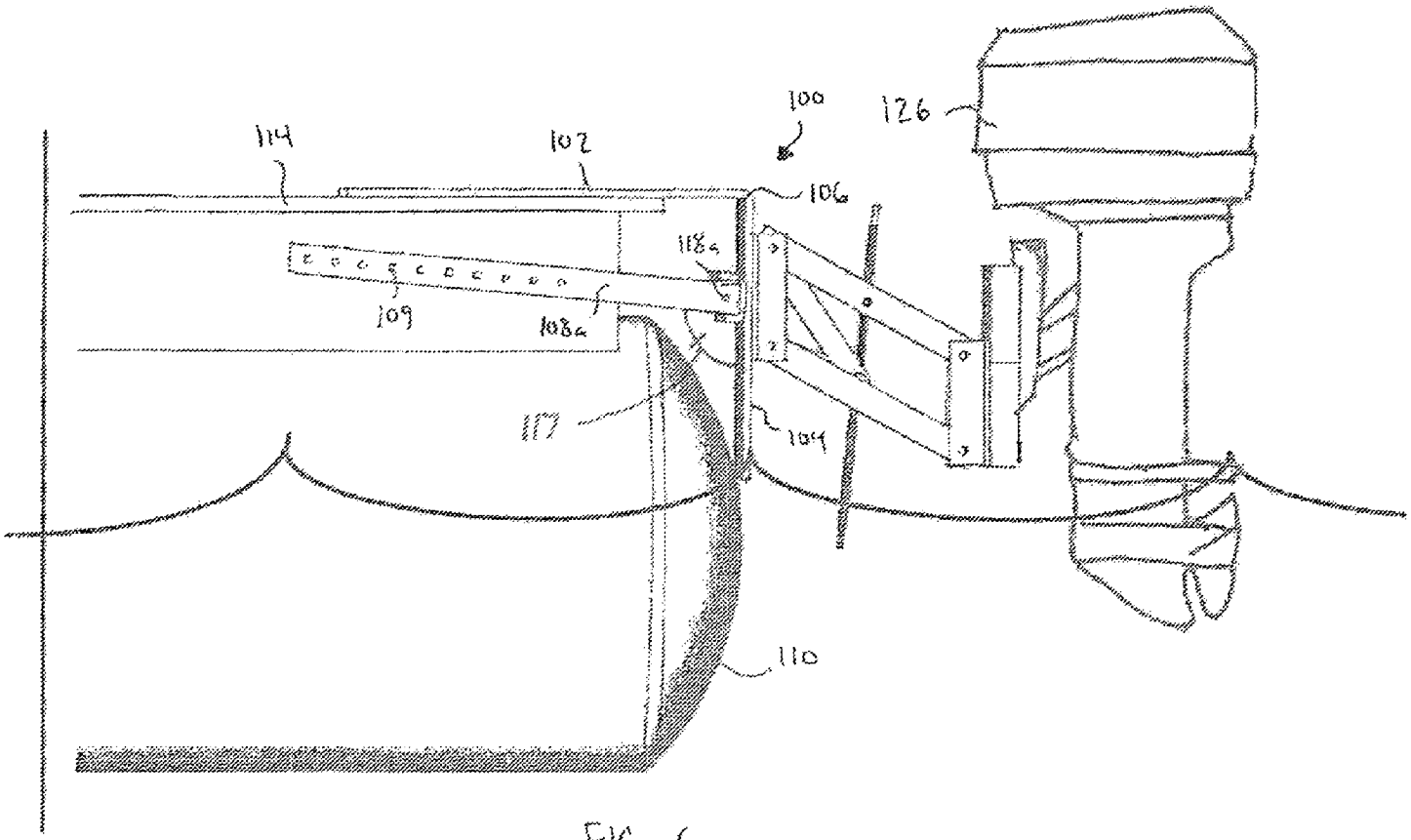
FIG. 6 is a side elevational view of a motor assembly attached via a jack plate mounted over a pontoon hull.

Supporting extensions 108*a* and 108*b* are coupled together to upper pivoting housing 120 at apertures 118*a* and 118*b*, respectively. Upper pivoting housing 120 rests flush along the face of lower pivoting housing 122 where both upper pivoting housing 120 and lower pivoting housing 122 are coupled to downward member 104. To facilitate the coupling of upper pivoting housing 120 and lower pivoting housing 122, slit 124 runs along the face of upper pivoting housing 120 as well as lower pivoting housing 122 to provide an opening for fasteners to attach through upper pivoting housing 120, lower pivoting housing 122 and into downward member 104 through apertures 105. Supporting extensions 108*a* and 108*b* of the supporting member 108 can extend from downward member 104 back to pontoon hull extension 116 at an angle 117, which, as seen in FIG. 6, is greater than 90°. Upper pivoting housing 120 and lower pivoting housing 122 facilitate this angle 117 by operation of the fastening through slit 124 of upper pivoting housing 120 such that upper pivoting housing 120 rests along the lip of lower pivoting housing 122. The lip of lower pivoting housing 122 provides additional mechanical friction to aid supporting extensions 108*a* and 108*b* in attaching to downward member 104.

In installing jack plate 100 to a pontoon boat, horizontal member 102 is fastened through one or more apertures 103, preferably with a fastener through at least one aperture 103 along first horizontal extension 102*a* and with a fastener through at least one aperture 103 along second horizontal extension 102*b*. Due to the rigid attachment of downward member 104 to horizontal member 102 at joint 106, downward member 104 then extends below the plane of decking platform 114. Supporting member 108 is then secured. Upper pivoting housing 120 and lower pivoting housing 122 are aligned such that slit 124 exposes the selected apertures 105 along downward member 104 at the location where supporting member 108 is to be affixed. Fasteners are implemented through slit 124 and apertures 105 to secure upper pivoting housing 120 and lower pivoting housing 122 and the extensions of first supporting extension 108*a* at joint 118*a* and second supporting extension 108*b* at joint 118*b*. First supporting extension 108*a* and second supporting extension 108*b* are then fastened to pontoon hull extension 116 through one or more apertures 109, preferably with a fastener through at least one aperture 109 along first supporting extension 108*a* and with a fastener through at least one aperture 109 along second supporting extension 108*b*.

Once jack plate 100 has been secured as described, adapter bracket 112 or a motor 126 can be coupled to downward member 104 through one or more apertures 105, preferably with a fastener through at least one aperture 105 along one side of the face of downward member 104, and with a fastener through at least one aperture 105 along the opposite side of the face of downward member 104. In the case of a motor 126 being secured to jack plate 100, the motor is then ready to propel the pontoon. In the case of adapter bracket 112 being secured to jack plate 100, a motor 126 can be subsequently secured to adapter bracket 112 such that it can propel the pontoon.

Figure 7:
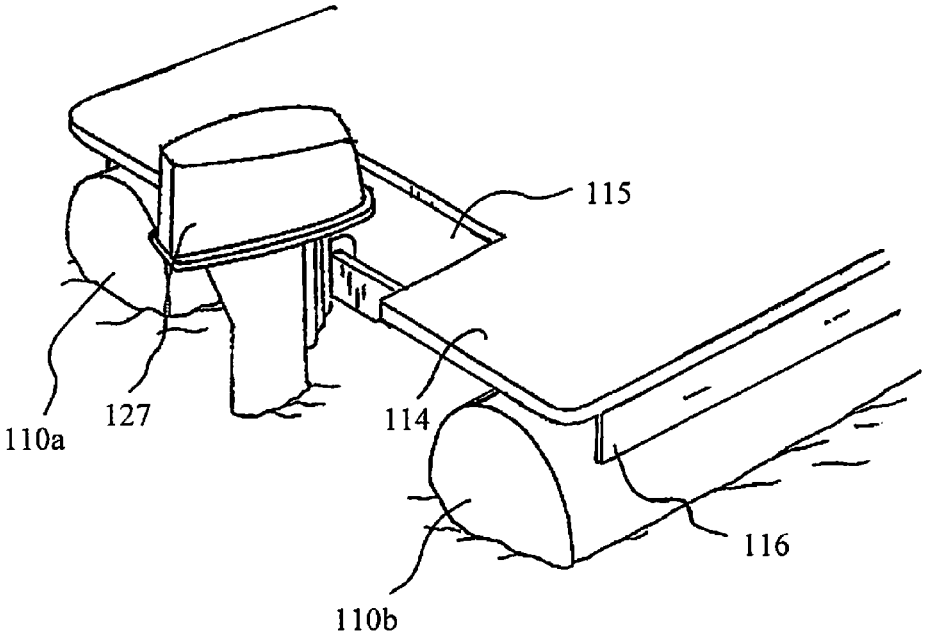
FIG. 7 is a perspective view of a stern end of a pontoon boat.

FIG. 7 shows the stern end of the pontoon boat without the jack plate 100 and the motor 126. FIG. 7 shows the void 115 between the starboard side pontoon hull 110*b* and the port side pontoon hull 110*a* where the primary motor 127 is traditionally located. The jack plate 100 and the motor (secondary) 126 may be mounted over the stern end of the starboard side pontoon hull 110*b* and the port side pontoon hull 110*a*.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims that are included in the documents are incorporated by reference into the claims of the present application. The claims of any of the documents are, however, incorporated as part of the disclosure herein, unless specifically excluded. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A mount for mounting a secondary motor to a pontoon boat for trolling in combination with the pontoon boat having a primary motor and the secondary motor, the pontoon boat having a stern end, a side, a first pontoon hull and a second pontoon hull, each pontoon hull being elongated and having a stern end oriented at the stern end of the pontoon boat and an axis, and a decking platform mounted on the first and second pontoon hulls, the decking platform having a stern end portion whereat the decking platform longitudinally terminates, wherein the primary motor is positioned at the stern end of the pontoon boat between the first and second pontoon hulls, the mount comprising:

a horizontal supporting member affixed to the decking platform and having a top surface and an opposite bottom surface, the horizontal supporting member being parallel with the decking platform and extending longitudinally beyond the stern end portion of the decking platform;

a downward member having a top periphery and a bottom periphery and a front surface and an opposite back surface disposed between the top periphery and the bottom periphery, wherein the front surface faces in a direction toward the decking platform and is longitudinally spaced from the stern end portion of the decking platform, the downward member being rigidly fixed to the horizontal supporting member and extending from the horizontal member downwardly, wherein the front and back surfaces of the downward member are perpendicularly oriented relative to the axis of the first pontoon hull and, from a view of the side of the pontoon boat, the combination of the horizontal supporting member and the downward member form an "L" shape rotated 90 degrees, wherein the downward member forms one leg of the "L" and the horizontal supporting member forms the other leg of the "L"; a supporting member comprising a first supporting extension and a second supporting extension, wherein each of the first and second supporting extensions is operably coupled on a first end to the downward member at an intermediate position between the top periphery and the bottom periphery, the first and second supporting extensions each comprising a second end wherein the second end of the first supporting member is affixed to a first pontoon hull extension downwardly oriented from the decking platform and the second end of the second supporting member is affixed to a second pontoon hull extension downwardly oriented from the decking platform, the horizontal supporting member being positioned substantially between the first and second supporting extensions, wherein the secondary motor is operably coupled to the back surface of the downward member.

2. The mount in combination with the pontoon boat of claim 1, wherein the supporting member extends from the downward member at an angle that is greater than 90 degrees.

3. The mount in combination with the pontoon boat of claim 1, wherein the coupling of the supporting member to the downward member is adjustable such that the first ends of the first and second supporting extensions of the supporting member may be coupled to the downward member at a plurality of intermediate positions vertically spaced between the top periphery and the bottom periphery of the downward member.

4. The mount in combination with the pontoon boat of claim 1, wherein the secondary motor is operably coupled to the downward member such that the secondary motor does not extend below the first pontoon hull.

5. A method for mounting a secondary motor to a pontoon boat for trolling, the pontoon boat having, a primary motor, a stern first end, a side, a first pontoon hull and a second pontoon hull, each pontoon hull being elongated and having a stern end oriented at the stern end of the pontoon boat and an axis, a decking platform mounted on the first and second pontoon hulls, the decking platform having a stern end portion whereat the decking platform longitudinally terminates, and first and second pontoon hull extensions downwardly oriented from the decking platform, wherein the primary motor is positioned at the stern end of the pontoon boat between the first and second pontoon hulls, the method comprising:

providing a mount comprising a horizontal supporting member having a top surface and an opposite bottom surface and affixable to the decking platform, a downward member having a top periphery, a bottom periphery, a front surface facing in a direction toward the decking platform and an opposite back surface disposed between the top periphery and the bottom periphery, the downward member being rigidly fixed to the horizontal supporting member and extending from the horizontal member downwardly and a supporting member comprising a first supporting extension and a second supporting extension, the first and the second supporting extensions each comprising a first and a second end;

securing the horizontal supporting member to the decking platform of the pontoon, such that the top and bottom surfaces are parallel with the decking platform and the horizontal supporting member extends longitudinally beyond the stern end portion of the decking platform and wherein the front and back surfaces of the downward member are perpendicularly oriented relative to the axis of the first pontoon hull and longitudinally spaced from the stern end portion of the decking platform and, from a view of the side of the pontoon boat, the combination of the horizontal supporting member and the downward member form an "L" shape rotated 90 degrees, wherein the downward member forms one leg of the "L" and the horizontal supporting member forms the other leg of the "L"; operably coupling the first ends of the first and second supporting extensions to the downward member at an intermediate position between the top periphery and the bottom periphery; affixing the second end of the first supporting member to the first pontoon hull extension and the second end of the second supporting member to the second pontoon hull extension, the horizontal supporting member being positioned substantially between the first and second supporting extensions; and operably coupling the secondary motor to the downward member.

6. The method of claim 5, wherein the coupling of the supporting member to the downward member is adjustable such that the supporting member may be coupled to the downward at a plurality of intermediate positions vertically spaced between the top periphery and the bottom periphery of the downward member.

7. The mount in combination with the pontoon boat of claim 1, wherein the horizontal supporting member is positioned over the stern end of the first pontoon hull and the downward member is positioned longitudinally beyond the stern end of the first pontoon hull.

8. The mount in combination with the pontoon boat of claim 3, wherein the horizontal supporting member is positioned over the stern end of the first pontoon hull and the downward member is positioned longitudinally beyond the stern end of the first pontoon hull.

9. The mount in combination with the pontoon boat of claim 1, the mount further comprising an adapter bracket, wherein the adapter bracket is secured to the back surface of the downward member and extends longitudinally beyond the stern end of the first pontoon hull and wherein the secondary motor is operably coupled to the adapter bracket.

10. The mount in combination with the pontoon boat of claim 3, the mount further comprising an adapter bracket, wherein the adapter bracket is secured to the back surface of the downward member and extends longitudinally beyond the stern end of the first pontoon hull and wherein the secondary motor is operably coupled to the adapter bracket.

11. The mount in combination with the pontoon boat of claim 1, the mount further comprising an adapter bracket, wherein the adapter bracket is secured to the back surface of the downward member and extends longitudinally away from the stern end of the pontoon boat and is positioned longitudinally beyond the stern end of the first pontoon hull and wherein the secondary motor is operably coupled to the adapter bracket.

12. The mount in combination with the pontoon boat of claim 3, wherein the supporting member is adjustable in its coupling to the downward member via a plurality of engaging apertures in the downward member vertically spaced between the top periphery and the bottom periphery.

13. The mount in combination with the pontoon boat of claim 1, wherein the supporting member is adjustable in its coupling to the downward member via a plurality of engaging apertures in the downward member vertically spaced between the top periphery and the bottom periphery.

14. The mount in combination with the pontoon boat of claim 1, wherein the pontoon hull extension is perpendicularly oriented relative to the decking platform and the first and second supporting extensions are linear.

* * * * *